United States Patent [19]

Wood

[11] 4,051,547

[45] Sept. 27, 1977

[54] SOLID STATE RELAY

[76] Inventor: Frederick Wood, 8111 Yonge St., Apt. 1504, Thornhill, Ontario, Canada

[21] Appl. No.: 623,092

[22] Filed: Oct. 16, 1975

[51] Int. Cl.[2] ..... H01H 47/22

[52] U.S. Cl. ..... 361/160; 307/114

[58] Field of Search ..... 317/198.5 B, DIG. 9; 307/112, 114, 116; 361/160, 170

[56] References Cited

U.S. PATENT DOCUMENTS

| | | | |
|---|---|---|---|
| 2,507,976 | 5/1950 | Hull | 307/114 X |
| 3,418,488 | 12/1968 | Platzer | 317/DIG. 9 |
| 3,462,233 | 8/1969 | Matthews | 317/148.5 B |

*Primary Examiner*—Harry E. Moose, Jr.

[57] ABSTRACT

An electrical relay control circuit device which is connected to a controlling load such as a motion picture machine from a power source, and to controlled load such as the room lights, so that when the machine is in operation, the room lights cut off, and when the machine is cut off, then the room lights are turned on. The circuitry includes a transformer the primary of which carries the current to the controlling load, so that the secondary exhibits voltage when the controlling load is in operation, there being a relay switch for opening the circuit to the room light load, and Triac means for controlling the relay switch.

2 Claims, 2 Drawing Figures

SOLID STATE RELAY

The invention relates to improvements in electrical relay control circuit devices whereby the mode of operation or lack of operation of a controlling unit controls the mode of operation or lack of operation of a controlled unit.

SUMMARY OF THE INVENTION

An object of the invention is to provide a novel and improved electrical relay control circuit device for use in connection with a controlling unit and a controlled unit, so that the operation of the controlled unit or cessation thereof results from the mode of operation or cessation of operation of the controlling unit.

Another object of the invention is to provide a novel and improved electrical relay control circuit and apparatus which is connected to a controlling unit and a controlled unit, so that when the controlling unit is turned off, the controlled unit is immediately turned on, and so that when the controlling unit is turned on, the controlled unit is immediately turned off.

A further object of the invention is to provide a novel and improved electrical relay control circuit and apparatus by means of which a controlling unit automatically turns on or off a controlled unit according to a predetermined pattern of interrelated operation of both units.

Still another object of the invention is to provide a novel and improved electrical relay control circuit and apparatus which is operable at a low current with a minimal voltage drop, and which can be applied to any alternating current circuit in which a change of operation of units connected thereto has to be brought about by the starting or stopping of a current flow as opposed to the more conventional on/off voltage switching.

Still a further object of the invention is to provide a novel and improved electrical relay control circuit and apparatus which is simple in design, made up of very few parts, and which will fit into a small cabinet, and which can be made at low cost, by hand or by mass production methods.

BRIEF DESCRIPTION OF THE DRAWINGS

These and other objects, features and advantages of the invention will become apparent from the following description of a preferred embodiment thereof, as illustrated in the accompanying drawings, forming a part hereof.

In the drawings.

BACKGROUND OF THE INVENTION

In connection with the use of electrical devices, such as equipment the stopping of which could cause damage to other connected components unless the components are also stopped, it is known that controls are needed to handle such occurrences. For example, this may involve turning room lights on or off depending on the starting or stopping of a movie projector. Also the starting and stopping of a dust extracting unit, vacuum cleaner or the like coincident with turning a power saw, router and the like, on or off. Further, operating an alarm to indicate the failure of any connected device, particularly in the medical fields, such as in use of an iron lung for immediate summoning of assistance to the patient. The present invention is intended to solve such problems in a simple manner.

DETAILED DESCRIPTION OF PREFERRED EMBODIMENT

In order to understand clearly the nature of the invention, and the best means for carrying it out, reference may be had to the drawings, in which like numerals denote similar parts throughout the several views.

Figure 1:
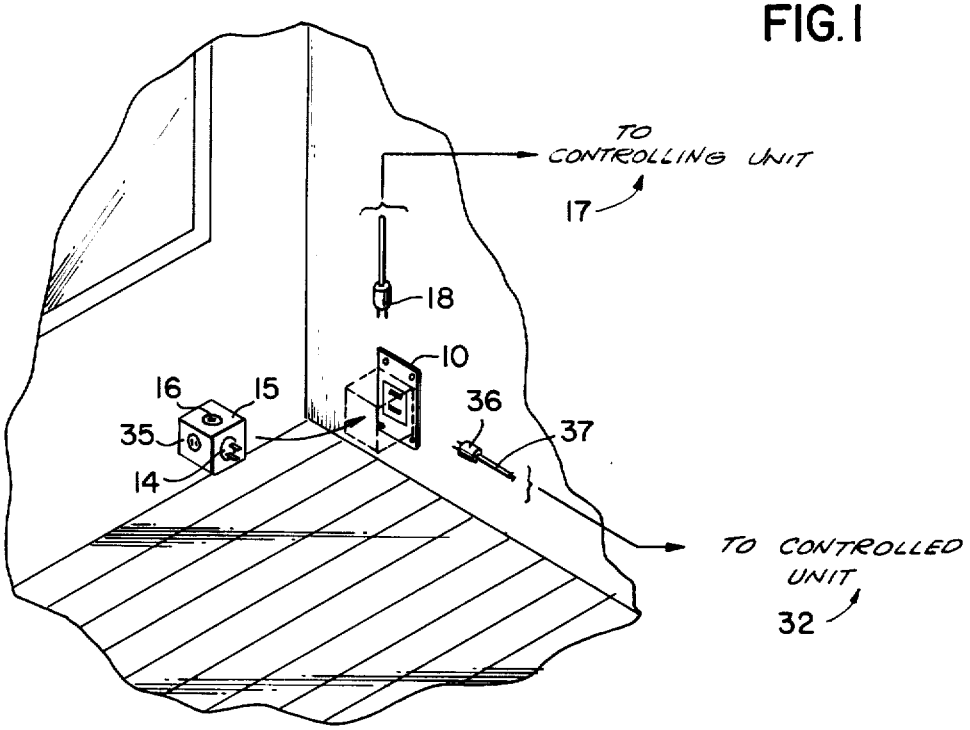
FIG. 1 is a perspective view of a corner of a room with the device ready for installation and connection to the power lines and the controlling and controlled units.

As shown in FIG. 1, there is a base power line outlet 10 connected to the alternating current lines of the building. Power input wires 12 and 13 are connected to the prongs 14 of the device, for insertion into the base outlet 10, the wires being connected inside the cabinet 15 as shown in FIG. 1, so that the whole cabinet is plugged into the base outlet 10.

Figure 2:
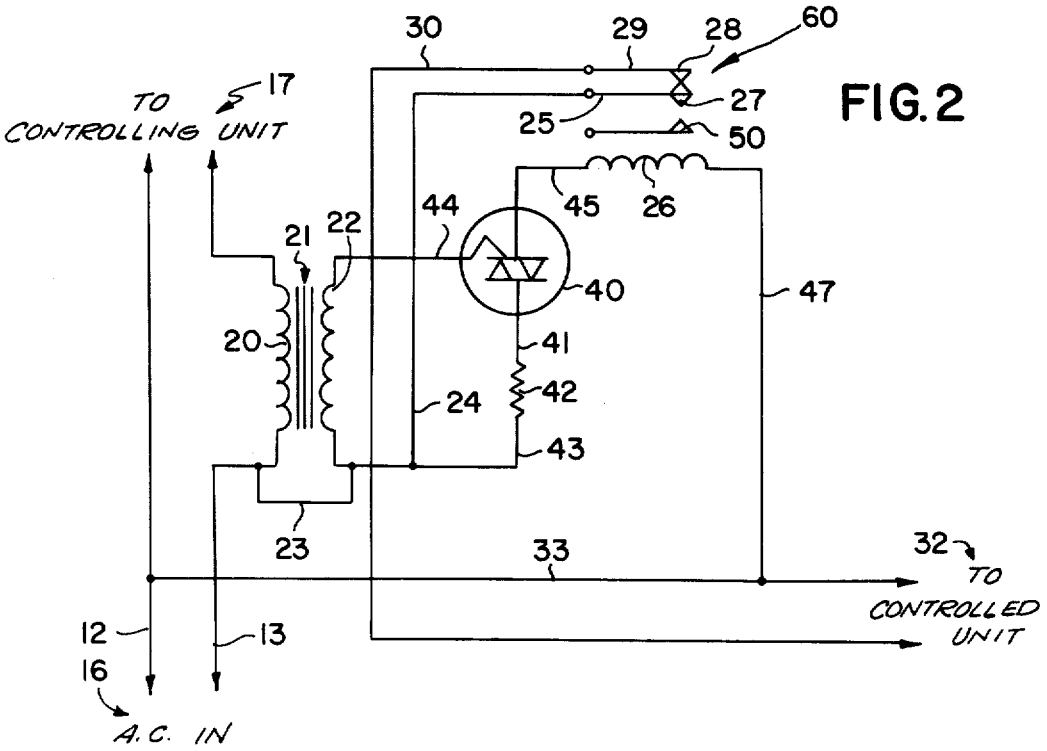
FIG. 2 is a schematic circuit diagram of the device, showing the connections of the various elements and the connections to the controlling and controlled units.

The wires 12 and 13 lead to a receptable 16 in the cabinet 15, so that a controlling unit 17 may be plugged into the receptacle 16 by plug 18. As shown in FIG. 2, the wire 13 leads through the primary winding 20 of a transformer 21, the secondary winding 22 of which is connected at one end by wire 23 to the power input wire 13.

Wire 23 is connected to wire 24 which in turn is connected to the movable switch blade 25 of a relay generally denoted by the reference numeral 60. The contact 27 of the blade 25 is shown in closed engagement with the stationary contact 28 of the stationary relay switch blade 29. A wire 30 connects the stationary blade 29 to the controlled unit 32. As shown in FIG. 2 a wire 33 connects from power input wire 12 to the other side of the controlled unit 32. The two wires 30 and 33 are connected inside the small cabinet 15 to the receptacle 35, into which the plug 36 is inserted. The plug 36 is inserted to the wires 37 connected to the controlled unit 32.

It is thus seen from FIGS. 1 and 2, that when the plug 18 from the controlling unit 17 is plugged into the receptacle 16 in cabinet 15, the controlling unit is connected to the power lines for being operated therefrom and that the current drawn flows through the primary winding 20 of the transformer 21, thereby inducing a voltage across the secondary 22 of the transformer. Also, when the controlled unit plug 36 is plugged into the receptacle 35 current from the lines 12 and 13 reaches the controlled unit through the engaged relay contacts 27 and 28.

However, it may be desired that when the controlling unit is running, such as a movie projector, that the room lights which would be the controlled unit, be turned off, and for this purpose a current control device 40 is shown in the circuit, the device 40 being a solid state bidirectional switch or Triac. The Triac 40 has one terminal connected via wire 41 through resistor 42 and wire 43 to one end of the secondary winding 22 and also to the power input wire 13, via jumper wire 23. Another terminal of Triac 40 is connected by wire 44 to the other end of the transformer secondary 22, and a third terminal is connected via wire 45 through the winding 26 of the relay 60, and thence by wires 47 and 33 to wire 12, and thus to the power input 16.

As will be understood by those skilled in the art, it is seen that when the controlling unit, 17, such as a movie projector is operating, the current flowing through the primary of the transformer 21 induces voltage in its secondary, the effect of using the Triac 40 being to allow current to flow through the relay winding 26, opening the switch blade contact 27 away from stationary contact 28 and to stationary contact 50, thereby preventing current flow to the controlled unit, such as the room lights, whereby they are then cut off.

When the controlling unit, such as the movie projector 17 is turned off, the spring biased movable switch blade 25 returns into contact with fixed contact 28, permitting current flow to the controlled unit 32, that is, the receptacle oriented room lights, and turning them on. Other uses will be apparent from the above explanation to those skilled in the art as explained. For example, this device can operate with a current of 25 milliamperes and a voltage drop across the coil (transformer primary) of only 0.16 volts RMS.

Although the invention has been described in specific terms, it will be understood that variations may be made in size, shape, materials and arrangement without departing from the spirit and scope of the invention as claimed.

What is claimed is:

1. An electrical relay control circuit device comprising power input means connectable to a source of electrical power for receiving power therefrom, first power output means connectable to a controlling load unit device for delivering power from said power input means thereto, second power output means connectable to a controlled load unit device for delivering power from said first power input means thereto, and switching circuit means between said power input means and second power output means for selectively regulating the delivery of said power to said controlled load unit device in response to the flow or nonflow of power to said first power output means, said switching circuit means including normally closed relay switch means between said power input means and said second power output means, and solid state bidirectional switch means for opening said relay means to de-energize said controlled unit in response to the flow of power from said power input means to said first power output means.

2. An electrical relay control circuit device in accordance with claim 1, comprising a first pair of electrical wires connected to said power input means for delivering electrical power therefrom to said first power output means and therefrom to said controlling load unit device, said power input means including transformer means, said transformer means comprising transformer primary winding means interposed in one of said first pair of electrical wires, and transformer secondary winding means for producing secondary voltages responsive to current flow in said primary winding means, a second pair of electrical wires connected to said power input means for supplying electrical power therefrom to said controlled load unit device, said normally closed relay switch means being interposed in one of said second pair of wires, a relay switch coil means in said relay switch means connected to said transformer secondary winding means, and a "Triac" solid state bidirectional switch and resistor means connected in parallel across said transformer secondary winding means and in series with said relay switch coil means for permitting electrical power flow to said relay switch coil means to energize the same to open said relay switch means and thereby ceasing electrical power flow to said controlled load unit device in response to power flow through said transformer primary winding means to said concontrolling load unit device.

* * * * *